US005431087A

United States Patent [19]

Kambara

[11] Patent Number: 5,431,087

[45] Date of Patent: Jul. 11, 1995

[54] EXTENDED STROKE LINEAR ACTUATOR ASSEMBLY

[76] Inventor: Goro Kambara, 13730 Via Encantado, Valley Center, Calif. 92082

[21] Appl. No.: 260,015

[22] Filed: Jun. 15, 1994

[51] Int. Cl.[6] ..... F01B 1/00

[52] U.S. Cl. ..... 92/146; 92/61; 92/160; 92/165 R

[58] Field of Search ..... 92/146, 161, 61, 75, 92/151, 150, 160; 91/508

[56] References Cited

U.S. PATENT DOCUMENTS 1,871,163 8/1932 Dilworth ..... 92/61
4,412,476 11/1983 Benaroya ..... 92/151
4,748,894 6/1988 Foster ..... 92/151
4,821,868 4/1989 Foster ..... 92/151

FOREIGN PATENT DOCUMENTS 217931 2/1909 Germany ..... 92/61

*Primary Examiner*—Thomas E. Denion

[57] ABSTRACT

An array of symmetrically disposed piston-cylinder assemblies may be utilized to produce oppositely directed movements along a single force axis. Plumbing between the various cylinders may be external or internal, or a combination thereof, the exact form depending upon the particular embodiment. The array may be fabricated as a unitized inter/plumbing configuration or from separate cylinders that are functionally retained about an inter/plumbing fixture.

11 Claims, 5 Drawing Sheets

EXTENDED STROKE LINEAR ACTUATOR ASSEMBLY

BACKGROUND—FIELD OF THE INVENTION

This invention relates to fluid-powered linear actuators, specifically to extended stroke actuators.

Discussion of Prior Art

Conventional fluid-powered linear actuators or rams utilize a piston and cylinder arrangement to produce linear movement. In such devices the stroke length is always shorter than the body length. Typically the stroke length equals the body length minus the thickness of the cylinder head and piston. In many configurations however it is desirable or necessary to have a greater stroke length than body length. Traditionally the problem was solved using a telescoping multi-stage configuration. By way of example such a situation would arise when a telescopic cylinder were used to tilt the truck bed of a dump truck. These telescopic stages are normally single-acting i.e. they are extended with fluid power but gravity or an additional outside force was required for retraction. This shortcoming resulted from the fact that it is difficult to provide a fluid passage for a return stroke within the movable cylinders. U.S. Pat. No. 3,973,468 to Russel (1973) disclosed a complex double-acting telescoping cylinder arrangement. It is noted however that this configuration is expensive to manufacture; consequently the utility of this device is sharply limited by cost considerations.

Telescoping cylinders also have other inherent shortcomings. They cannot be operated so as to extend a pre-determined or selected stage or group of stages. Moreover there is no convenient means for controlling the velocity at which each stage moves. When these factors are of significance, multiple stages have been configured from a combination of two or more actuators in series. It will be understood however that the body length increases proportionally. In many applications there is insufficient space to accommodate the desired structure.

Another disadvantage of the telescoping arrangement results from the high-friction caused by the pressure seals. The actuation pressure increases the force these seals exert on the adjacent outer cylinder walls. The resulting high friction is detrimental to any application where sensitive movement is required, such as an air hoist.

The actual problem posed therefore is that of providing an economical actuating device having an extended stroke which can be accurately controlled both as to position and velocity. In addition, it is highly desirable and a requirement in some application, that oppositely directed actuation forces produced no moment or couple, i.e., that the forces be balanced about a common center line which is coincident with the OPPOSITELY DIRECTED MOTIONS.

ACCORDINGLY, THE PRIMARY OBJECTS OF THE INVENTION ARE:

(A) To provide a cylindrical actuator configuration which has twice the stroke length of the convention linear actuator having the same body length.

(B) To provide a cylindrical array which functions in a double-acting capacity.

(C) To provide an economically feasible alternative to the conventional telescoping cylinder arrangement.

(D) To provide an extended stroke actuator which can be controlled so as to stop precisely at intermediate locations.

(E) To provide an actuator which can be speed controlled.

(F) To provide the above advantages through the use of standard commercially available cylinders.

(G) To provide a double stroke cylinder array having coincident axial thrusts.

These and other objects of the invention will be obvious from the detail description of the preferred embodiments shown herein below.

| REFERENCE NUMBERALS IN DRAWINGS | |
|---|---|
| 6 | plumbing out of cylinder |
| 7 | extra port in cylinder |
| 8 | inter cylinder plumbing |
| 10 | rod end bearing |
| 12 | pin |
| 14, 14a | rod connecting block with conduit bracket |
| 16, 16a | rod connecting block |
| 18 | rod connecting block screw |
| 20, 20a | tube conduit |
| 22 | tube conduit keeper plate |
| 24 | keeper plate screw |
| 26, 26a | cover |

-continued

| REFERENCE NUMBERALS IN DRAWINGS | |
|---|---|
| 27 | tangle free tube storage system |
| 28, 28a | tube guide |
| 30 | upper cylinder head |
| 32 | lower cylinder head |
| 34 | piston rod |
| 36 | piston rod bearing |
| 38 | piston rod seal |
| 40 | piston |
| 42 | piston seal |
| 44 | tie rod |
| 46 | inter-head plumbing module |
| 48 | module end seal |
| 50 | cylinder tube end seal |
| 52 | cylinder tube |
| 54 | tube guide locating screw |
| 56 | fluid port fitting |
| 58 | fluid tube |
| 60 | fluid passage plug |
| 62 | fluid passage |
| 64 | head/clyinder screw |
| 66 | fastening hole |
| 68 | inter-head fluid passage hole |
| 70 | gasket |
| 72 | unitized array |
| 74, 74a | tie-plate |
| 76 | fluid port angle fitting |
| 78 | cylinder mounting nut |
| 80 | inter-cylinder plumbing module |
| 82 | commercially available cylinder |
| 84 | adapter |
| 86 | plumbing module |
| 88 | plumbing module seal |
| 90 | plumbing module locating tube |
| 92 | tie-block |
| 94 | inter-cylinder/tie-block plumbinb module |
| 95 | head opening |
| 96 | head ports |
| 97 | adapter hole |

DETAILED DESCRIPTION OF A PREFERRED EMBODIMENT

Figure 1:
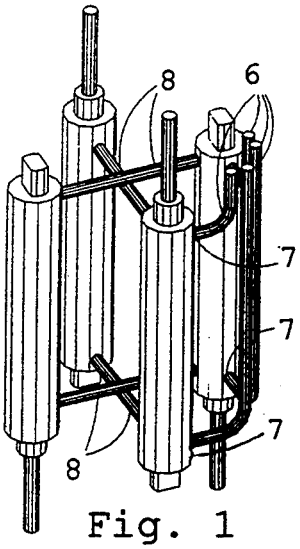
FIG. 1 shows a perspective diagram of how four cylinders can be internally and externally plumbed.

Referring to the drawings and particularly FIG. 1, there is shown the functional fluid paths and interconnections common to each of the embodiments described herein below. It will be understood that the fluid paths may be internal or external, the choice depending upon several factors such as cost, space and appearance—the final determination being a matter of design parameters. Specifically it will be instructive to observe that there are two ports per cylinder—consequently there are eight ports that must be internally connected by the inter-cylinder plumbing 8. In addition one of the cylinders 52 must function as a plumbing out cylinder via an extra port 7. Plumbing becomes a significant factor in assembly —both from the standpoint of economics and cosmetics. The plumbing devices associated with each of the embodiments thus represent an important aspect of the invention.

Figure 2:
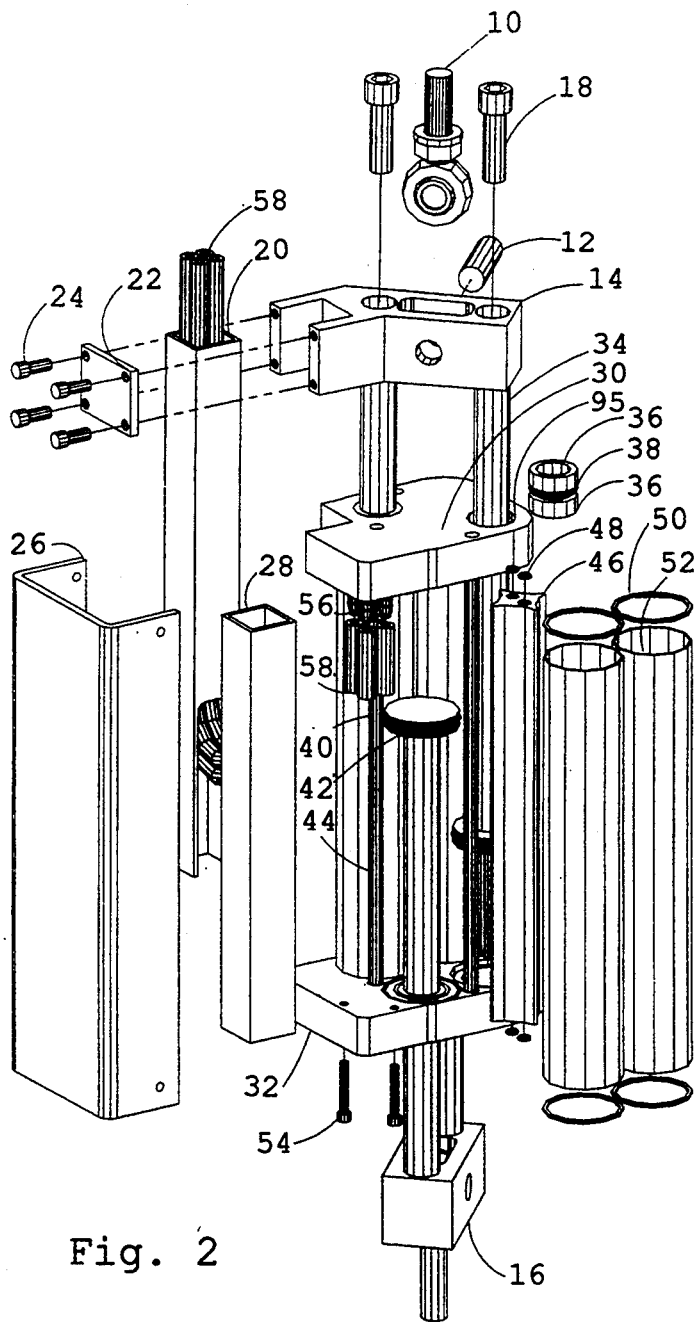
FIG. 2 shows one embodiment of the invention which utilizes four individual piston cylinder assemblies that are functionally inter-connected via an inter-head plumbing module and communicating ports in the heads.
Figure 2B:
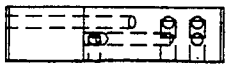
FIGS. 2A and 2B show elevation and plan views of upper head and the internal fluid passages within.
Figure 2A:
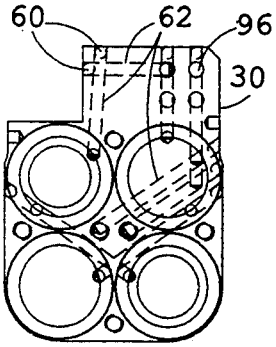
Figure 2C:
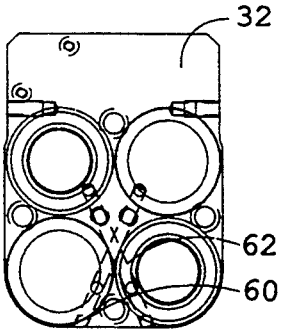
FIGS. 2C and 2D show elevation and bottom views of lower head and the internal fluid passages within.
Figure 2D:
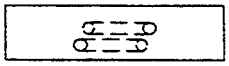

FIG. 2 shows a first preferred embodiment of the invention which comprises four individual cylinder tubes 52, joined by upper and lower cylinder heads 30 and 32 respectively. Each cylinder 52 houses a piston 40 which is connected to a piston rod 34. The pistons 40 are fitted with piston seals 42 and the piston rods 34 are sealed by the piston rod seals 38, each of which is positioned between a pair of piston rod bearings 36 which are located within the actuator head openings 95. Two of the piston rods 34 exit through the lower cylinder head 32 and the other two piston rods 34 exit through the upper cylinder head 30. Each piston rod is adapted to slide within the piston rod bearings 36 so that each pair of pistons extend in opposite directions. Upper cylinder head 30 and lower cylinder head 32 secure the four cylinder tubes 52 together via tie rods 44 which function in addition to press the heads 30 and 32 against the cylinder tube end seals 50. The two piston rods 34 which exit through lower cylinder head 32 attach to a rod connecting block 16 having two rod connecting block screws 18. A rod end bearing 10 is mounted in rod connecting block 16 with a pin 2 for the purpose of attaching the entire unit to a mating part (not shown). The other two rods which exit through the upper cylinder head 30 are attached to a rod connecting block 14 which is designed to function as a clamp for holding tube conduit 20 via keeper plate 22 and attachment screws 24. The tube conduit 20 houses four fluid tubes 58, and moves together with rod connecting block 14. One end of the housed tubes 58 connects to the ports 96 in upper cylinder head 30 via port fittings 56. When the tube conduit 20 moves, the tubes are either taken up or laid into the conduit 20—so that the tube conduit 20 functions in combination with the tube guide 28 to effectuate a tangle free tube storage system. Tube guide 28 is positioned between the upper head 30 and lower head 32 by tube guide locating screw 54. Cover 26 protects the tube conduit 20, tube guide 28 and fluid tubes 58. Within the space formed by the four cylinder tubes 52, an inter-head plumbing module 46 (together with its end seals 48) is positioned so as to transmit fluid from one head to the other. FIGS. 2A and 2B show the internal fluid passages 62 in upper cylinder head 30 and FIGS. 2C and 2D show the internal fluid passages in lower cylinder head 32. Each of the fluid passages 62 is plugged at one end with a fluid passage plug 60. The "four" cylinders 52 are symmetrically disposed with rod and bearings 10 located on the center line of the "four cylinder" array so that the oppositely directed actuating forces are transmitted to the load through a common axis, i.e., without producing a torque or couple.

Figure 3:
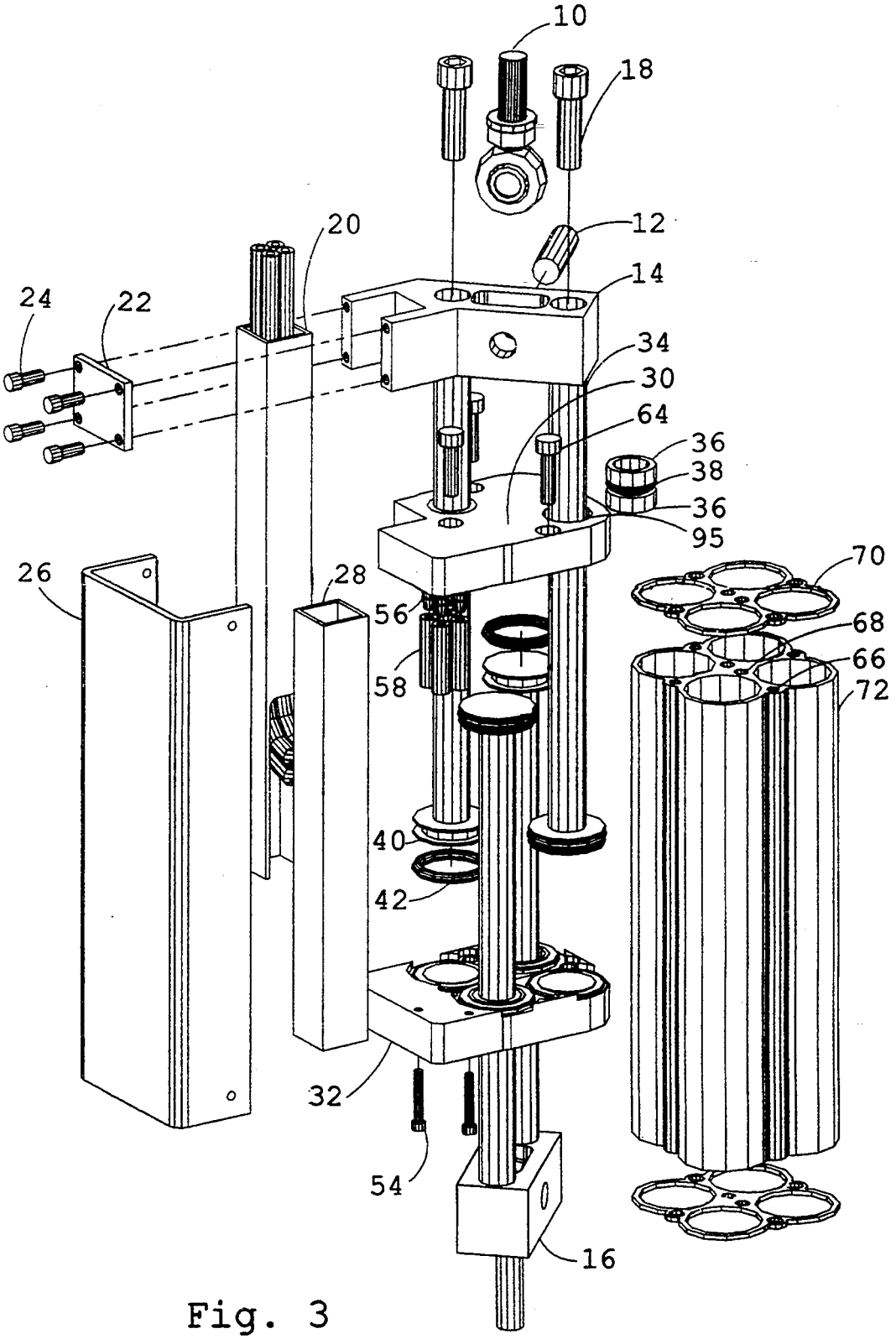
FIG. 3 shows another embodiment of the actuator using unitized cylinder tubes with built-in inter-head fluid passages.

FIG. 3 shows a modification of the embodiment shown in FIG. 2 wherein the four individual cylinder tubes are replaced with a unitized array 72. In addition, the common gasket 70 replaces both the individual module end seals 48 and the individual cylinder tube end seals 50. Head cylinder screws 64 function in lieu of the rods 44 to secure the heads 30 and 32 to the unitized array via the threaded hole 66.

Figure 4:
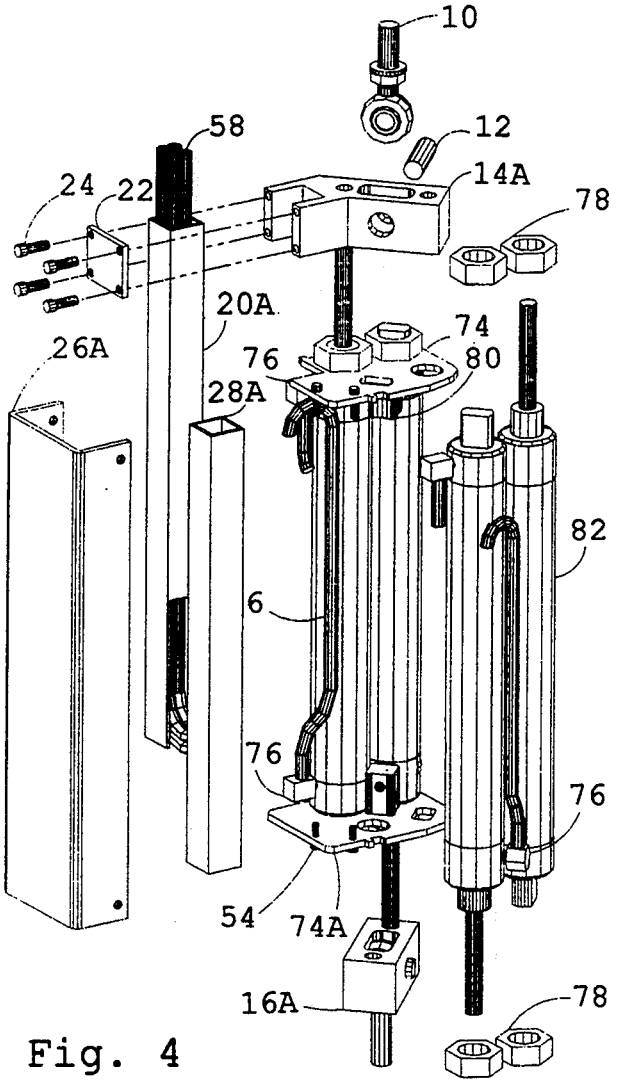
FIG. 4 shows another embodiment of the actuator using four commercially available cylinders plumbed together via inter- cylinder plumbing modules.
Figure 4B:
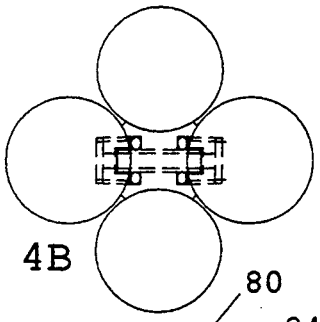
FIGS. 4A and 4B are cross-sectioned elevation and plan views showing how the cylinder ports are connected together using an inter-cylinder plumbing module.
Figure 4A:
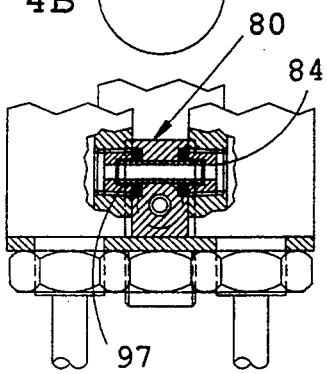
Figure 4C:
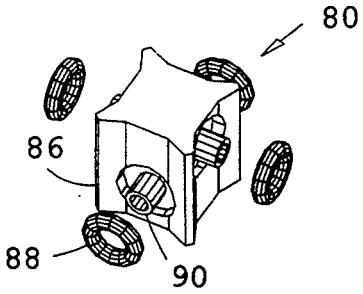
FIG. 4C shows a perspective view of the inter-cylinder plumbing module used in FIG. 4A.

FIG. 4 depicts an alternative construction wherein commercially available cylinders 82 are utilized in conjunction with tie plates 74 and 74A, the latter functioning in combination with the cylinder mounting nuts 78 to hold the assembly together. In lieu of the head plumbing configuration previously described in connection with FIG. 2, the embodiment shown in FIG. 4 utilizes an inter-cylinder plumbing module 80 to effectuate the internal plumbing between cylinder ports. Plumbing out of cylinder 6 is through fluid port angle fitting 76—there being no fluid passages (e.g. 62) in the plate 74. The actual connection between cylinder ports is implemented by the inter cylinder plumbing module 80 as illustrated in FIGS. 4A and 4B. As shown in FIGS. 4A and 4B, adapters 84 are installed in the cylinder ports to provide smooth flat surfaces for the plumbing module seals 88. The plumbing module locating tube 90 protrudes into plumbing module seals 88 so as to correctly position the module 80 relative to the holes 97 in adapter 84. The outer circumference of the plumbing module body 86 is contoured to match the surfaces of the four cylinders with which it communicates—consequently the module seals 88 are captured and retained by the structural configuration.

Figure 5:
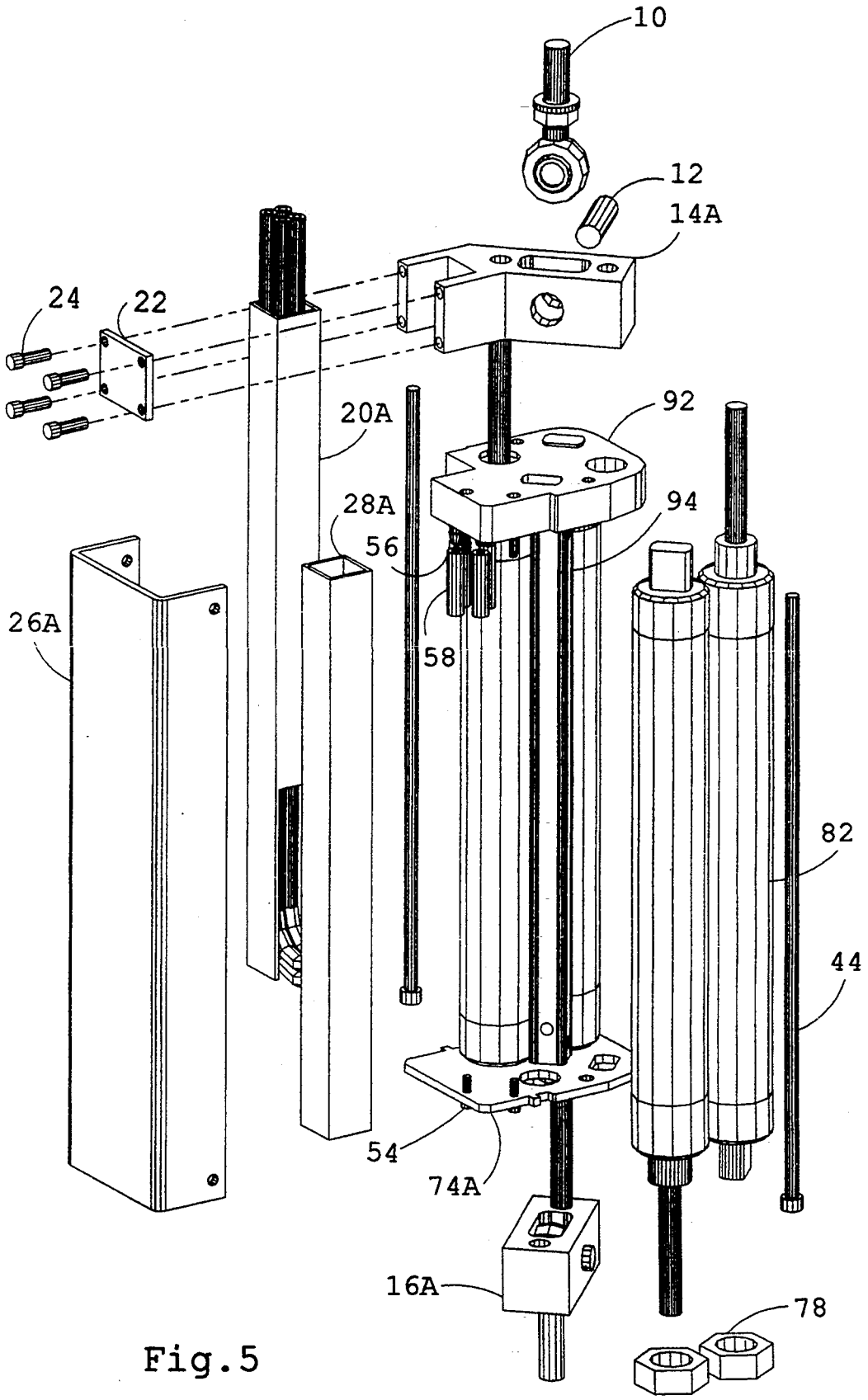
FIG. 5 shows how the external plumbing shown in FIG. 4 can be eliminated via an intercylinder/tie block plumbing module.
Figure 5H:
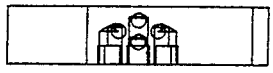
FIGS. 5G and 5H show elevation and plan views of the tie block of FIG. 5 and the internal passages within.
Figure 5G:
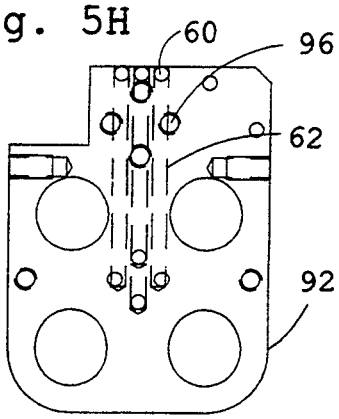
Figure 5A:
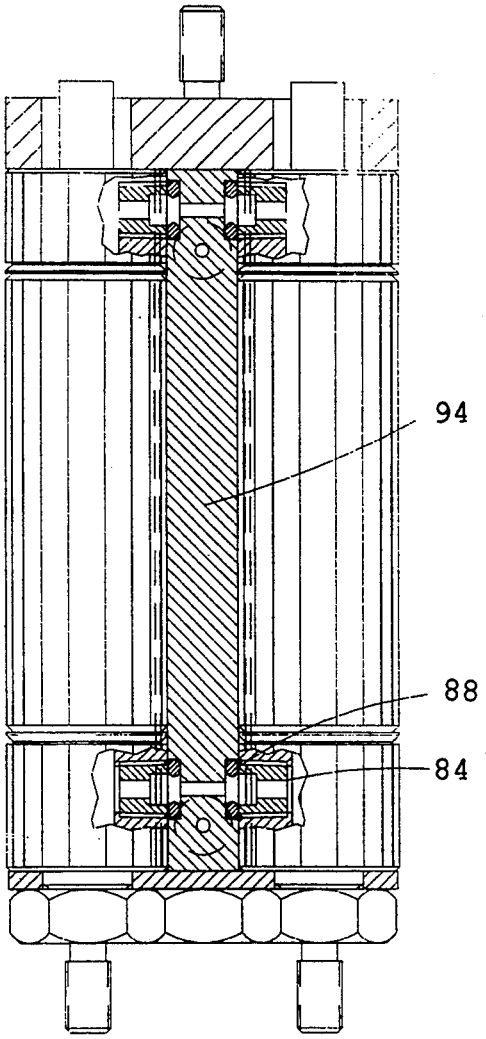
FIG. 5A is a cross-sectional view showing how the cylinder ports are connected to each other using the inter-cylinder/tie block plumbing module shown in FIG. 5.
Figure 5B:
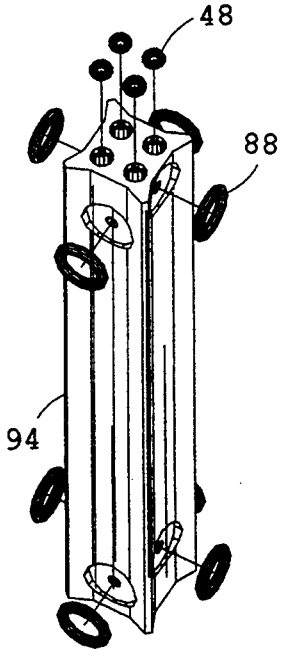
FIG. 5B shows a perspective view of the inter-cylinder/tie block plumbing module.
Figure 5F:
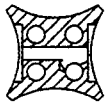
FIGS. 5C, 5D, 5E, and 5F are cross-sectioned views showing how each port of the inter-connection communicates with the longitudinal passages within the inter-cylinder/tie block plumbing module.
Figure 5E:
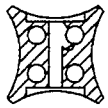
Figure 5D:
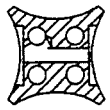
Figure 5C:
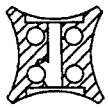

FIG. 5 shows another adaptation wherein the tie block 92 is used in lieu of tie plate 74 and an inter-cylinder/head plumbing module 94 is used to effectuate the internal plumbing. The inter-cylinder/head plumbing module 94 has an advantage over the inter-cylinder plumbing module 80 of FIG. 4 in that the plumbing out connection for cylinder 6 is eliminated. FIG. 5A is a cross sectional view showing how the cylinder ports are connected together and FIG. 5B shows the inter-cylinder head plumbing module in perspective. FIGS. 5C through 5F illustrate the longitudinal fluid passages via sectional views taken at each connecting hole, and FIGS. 5G and 5H show the internal fluid passages in tie block 92.

It will be evident to those having skill in the art, that other combinations of cylinders may be utilized to accomplish some of the objectives of the invention. Thus, one large center cylinder may be used in combination with two oppositely located smaller cylinders to achieve double-stroke range without producing a torque or couple about the assembly. It will also be evident that the teachings of the invention are equally applicable to shock absorbers, gas spring counterbalances, gas cushioning apparatus as well as numerous other hydraulic and pneumatic devices. Thus, although the invention has been shown and described by illustrating several adaptations of a preferred embodiment, it will be understood that the invention is not limited thereto, and that numerous changes, modifications and substitutions may be made without departing from the spirit of the invention.

What this claim is:

1. A Linear Actuator Comprising:

a first cylinder;

a first piston adapted to slide between opposite ends of said first cylinder;

a first rod connected to said first piston;

a second cylinder;

a second piston adapted to slide between the opposite ends of said second cylinder;

a second rod connected to said second piston;

a third cylinder;

a third piston adapted to slide between the opposite ends of said third cylinder;

a third rod connected to said third piston;

a fourth cylinder;

a fourth piston adapted to slide between the opposite ends of said fourth cylinder;

a rod connected to said fourth piston;

connecting means for attaching said first, second, third and fourth cylinders together so as to position the axis of each of said cylinders parallel to each of the others whereby said first and second rods will exit in the same direction and said third and fourth rods will exit in the opposite direction;

first rod connecting means for attaching said first and second rods together whereby said first and second pistons can be caused to move in unison over a stroke length equal to the length of said first and second cylinders;

second rod connecting means for attaching said third and fourth rods together whereby said third and fourth pistons can be caused to move in unison over a stroke length equal to the length of said third and fourth cylinders;

plumbing means for applying pressure to said first, second, third and fourth pistons so as to cause the pistons within said first and second cylinders to move axially together in a first direction over a stroke length equal to the length of said first and second cylinders and to cause said pistons in said third and fourth cylinders to move axially together in a second direction opposite to said first direction over a stroke length equal to the said length of said third and fourth cylinders whereby the total stroke length will be equal to twice the length of the cylinders.

2. A Linear Actuator Comprising:

a first cylinder;

a first piston adapted to slide within said first cylinder;

a first rod connected to said first piston;

a second cylinder;

a second piston adapted to slide within said second cylinder;

a second rod connected to said second piston;

a third cylinder;

a third piston adapted to slide within said third cylinder;

a third rod connected to said third piston;

a fourth cylinder:

a fourth piston adapted to slide within said fourth cylinder;

a rod connected to said fourth piston;

connecting means for attaching said first, second, third and fourth cylinders together so as to position the axis of each of said cylinders parallel to each of the others whereby said first and second rods will exit in the same direction and said third and fourth rods will exit in the opposite direction;

first rod connecting means for attaching, said first and second rods together whereby said first and second pistons will be caused to move in unison;

second rod connecting means for attaching said third and fourth rods together whereby said third and fourth pistons will be caused to move in unison;

and wherein each of said first, second, third and fourth cylinders has a plurality of side wall openings where fluid may be entered or removed;

and further including plumbing means for connecting the openings between the side walls of said first, second, third and fourth cylinders;

and wherein said plumbing means further comprises an inter-cylinder plumbing module which includes:

a housing having an external configuration adapted to fit within the space between each of the first, second, third and fourth cylinders so as to form a cradle mount for restraining each of said cylinders in place, and having in addition, a plurality of side ports positioned so as to communicate with the openings in the side walls of said cylinders and a plurality of internal longitudinal passages each adapted to communicate with at least one side port.

3. The apparatus recited in claim 2 including a tie block mounted to one end of said inter-cylinder/tie block plumbing module, said tie block having a plurality of ports located so as to communicate with the longitudinal passages in said inter-cylinder tie block plumbing module.

4. A double stroke actuator comprising;

an array including a first pair of piston-cylinder assemblies for producing a linear stroke in a first direction, equal to the length of the first pair of cylinders, and a second pair of piston-cylinder assemblies for producing a linear stroke in a second direction, equal to the length of the second pair of cylinders, and opposite to that of said first direction;

means for attaching said first and second pair of cylinder assemblies together so as to position their thrust axis coaxially, whereby the force exerted by said oppositely moving pairs of pistons will be coaxial with respect to both pairs of cylinders with a combined stroke equal to twice the length of said assemblies;

an input port;

plumbing means for connecting said first and second groups of piston-cylinder assemblies to said input port whereby the pistons in each of said cylinders will be caused to move in opposite directions when pressure is applied through said input port.

5. The apparatus recited in claim 4 wherein said first and second pair of piston-cylinder assemblies each contains a pair of identical piston-cylinder units and wherein is included:

first piston connecting means for connecting the pair of pistons in said first group together whereby said first group of pistons will move in unison;

second piston connecting means for connecting the pair of pistons in said second group together whereby said second group of pistons will move in unison.

6. The apparatus recited in claim 4 wherein the cylinders of said array are unitized as a single body having a plurality of internal passages for inter-connections between said cylinders.

7. The apparatus recited in claim 5 wherein each of said cylinder assemblies is retained in its position relative to the other cylinder assemblies by a mounting assembly.

8. An extended stroke actuator comprising:

an array including a first group of piston-cylinder assemblies for producing a linear movement in a first direction, and a second group of piston-cylinder assemblies for producing a linear movement in a second direction, opposite to that of said first direction;

an input port;

plumbing means for connecting said first and second groups of piston-cylinder assemblies to said input non whereby the pistons in each of said cylinders will be caused to move in opposite directions when pressure is applied through said input port:

and wherein said first and second around of piston-cylinder assemblies each contains a pair of identical piston-cylinder units and wherein is included;

first piston connecting means for connecting the pair of pistons in said first group together whereby said first group of pistons will move in unison;

second piston connecting means for connecting the pair of pistons in said second group together whereby said second group of pistons will move in unison:

and wherein the cylinders of said array are unitized as a single body having a plurality of internal passages of inter-connections between said cylinders;

and wherein each of said cylinder assemblies is retained in its position relative to the other cylinder assemblies by a mounting assembly;

wherein said mounting assembly comprises:

an upper head having a plurality of passages and ports;

a lower head;

means for holding said upper and lower heads against the ends of said cylinder assemblies so as to retain the axis of all of said cylinders assemblies parallel.

9. The apparatus recited in claim 8 wherein is included:

external plumbing tubes connected to the ports in said upper head;

a conduit attached to said first piston connecting means for housing said external plumbing tubes.

10. A double-stroke actuator comprising:

a first array having at least two pistons-cylinder assemblies for producing a stroke deflection motion equal to the length of said first cylinder array in a first direction;

a second array having at least two piston cylinder assemblys for producing a stroke deflection equal to the length of said second cylinder array in a second direction opposite to that of said first direction;

and wherein the piston cylinder assemblies in said first and second arrays are of equal length and mounted together so as to have their opposite ends coincident:

coupling means for transmitting the forces produced by said first array and said second array along a common axis whereby the forces produced by said first and second arrays will be axially coincident.

11. The apparatus recited in claim 10 including:

plumbing means for connecting said cylinders of said first array together and for connecting said cylinders of said second array together and for connecting said cylinders of said first array with said cylinders of said second array whereby said first and second arrays will be caused to produce simultaneous motions in opposite directions.

* * * * *